US008087342B1

(12) United States Patent
Hall

(10) Patent No.: US 8,087,342 B1
(45) Date of Patent: Jan. 3, 2012

(54) MULTI-PURPOSE ARMORED VEHICLE

(76) Inventor: Kennith Hall, Torrance, CA (US)

( * ) Notice: Subject to any disclaimer, the term of this patent is extended or adjusted under 35 U.S.C. 154(b) by 1001 days.

(21) Appl. No.: 12/069,122

(22) Filed: Feb. 7, 2008

(51) Int. Cl.
*F41H 7/00* (2006.01)

(52) U.S. Cl. ..... 89/40.03; 89/40.09; 180/9.5

(58) Field of Classification Search ..... 89/40.03, 89/40.04, 40.09; 180/9.5; 414/686, 694
See application file for complete search history.

(56) References Cited

U.S. PATENT DOCUMENTS

| | | | | |
|---|---|---|---|---|
| 1,696,439 | A | 12/1928 | Knox | |
| D222,859 | S | 1/1972 | Delisle et al. | |
| 4,192,216 | A | 3/1980 | Wait | |
| 4,226,292 | A | 10/1980 | Monte et al. | |
| 4,483,407 | A | 11/1984 | Iwamoto et al. | |
| 5,431,240 | A | 7/1995 | Merritt | |
| 6,101,437 | A * | 8/2000 | Oshina et al. | 701/50 |
| D492,621 | S | 7/2004 | Morris | |
| 6,899,189 | B2 | 5/2005 | Overlach et al. | |
| 2001/0046433 | A1 * | 11/2001 | Nishimura et al. | 414/694 |
| 2005/0230163 | A1 | 10/2005 | Cunningham | |
| 2006/0237239 | A1 | 10/2006 | Bruner et al. | |

FOREIGN PATENT DOCUMENTS

EP 378 157 * 7/1990

* cited by examiner

*Primary Examiner* — Stephen M Johnson
(74) *Attorney, Agent, or Firm* — Patent Law & Venture Group; Gene Scott

(57) ABSTRACT

A multi-purpose armored vehicle is configured for a wide range of purposes by military and police units and in both defensive and offensive postures. A protective canopy covers an entrance to a cockpit capable of accommodating at least one person. The vehicle is sufficiently narrow to enable it to pass through conventional gates and also doorways to, and within buildings. A pair of armor-plated shields are pivotally engaged, and selectively positionable, with the sides of the vehicle, allowing shelter to personnel traveling alongside the vehicle. An extensible boom may be fitted with a wide range of hardware including weapons and communications equipment for dealing with situations involving criminals, terrorists, etc. The shields, boom movement and extension, and hardware are all controllable from the cockpit.

17 Claims, 3 Drawing Sheets

MULTI-PURPOSE ARMORED VEHICLE

CROSS-REFERENCE TO RELATED APPLICATIONS

Figure 1:
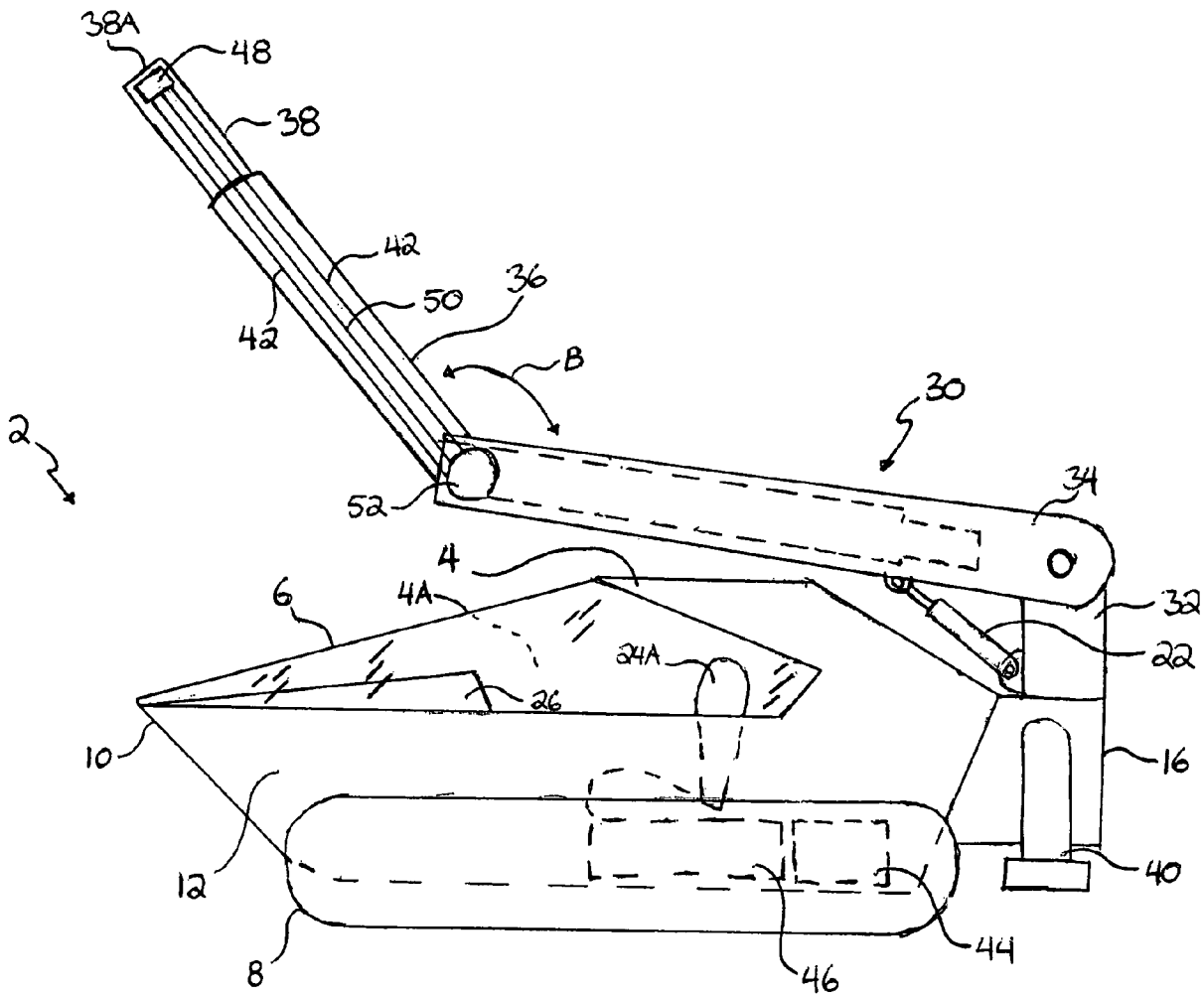

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to armored vehicles and, more particularly, to a small, compact, highly maneuverable, multi-purpose armored vehicle configured to be used for security purposes such as patrols, alarm responses, protection of police personnel in critical transactions in hostage situations, and support bomb threat situations.

2. Description of Related Art Including Information Disclosed Under 37 CFR 1.97 and 1.98

Cunningham, US 2005/0230163, discloses a motorized vehicle that includes a vehicle body having a rigid frame in a shape of a tractor; and a plurality of audio and visual devices disposed on the vehicle body, including a camera. The vehicle can be remote-controlled, and the vehicle body may be armored and may include a weapon system. The camera may be one of a motion, thermal, digital, and near infrared camera, and may be retractable into a housing. In another embodiment, the motorized vehicle, which may be remote-controlled, includes a vehicle body having a rigid frame in a rectangular shape with sloped sides; at least one storage unit accessed by doors, disposed within the vehicle body; and a camera disposed on the vehicle body.

Bruner et al., US 2006/0237239, discloses a powered personal utility vehicle having a quick-change body configuration with a mating tray assembling and a universal chassis is disclosed. The upper level of the mating tray houses electronics while the lower level engages with the universal chassis to form the personal utility vehicle. Reconfigurations are simplified with plug and play design electronics. Vehicle traction is increased through a specialized track and drive wheel design that improves contact between the surfaces allowing operation in multiple environments. The two-piece wheel design allows assembly of the inflatable drive molded balloon tire. Adjustment of inflation levels of the balloon tires controls track tension. Control is either manually programmed into the on-board central processing unit, or via carrier signals. Semi and fully autonomous operation is disclosed. Advanced operator interaction functions using two-way real time video and audio are disclosed along with LED and GPS systems. The invention as disclosed is configurable for a range of uses, load capacities and sizes.

Knox, U.S. Pat. No. 1,696,439, discloses a tank including a body, front and rear supporting wheels, endless tracks encircling the wheels, a motor within the body and positioned at its approximate longitudinal center, a planetary transmission directly in front of the motor for communicating power to the front wheels, a seat for the operator directly in rear of the motor and on the floor of the body, a plurality of foot controls on both sides of the motor, a cover hinged to the rear wall of the body, said cover and body formed to provide a streamline gun compartment, and an element of a gun-mount carried by the body and cover.

Delisle et al., U.S. D222,859, discloses a design for a tank-like vehicle body.

Wait, U.S. Pat. No. 4,192,216, discloses a small, low cost, very maneuverable, self-propelled, one-man armored vehicle makes use of a commercially available chassis and is especially adapted to be used for security purposes. The vehicle is provided with non-steerable wheels, all of which are driven, and controllably so on opposite sides for steering purposes.

Monte et al., U.S. Pat. No. 4,226,292, discloses a track-laying, remotely controlled, miniature target vehicle is shown, bearing an expendable shell which resembles a military tank.

Four grooved pulleys on each side carry two V-belts as tracks, one wheel being electric motor-driven. The two reversible electric motors, one for each side, run and are controlled independently of each other by means of speed control units receiving signals from an on-board radio receiver. A transmitter remote from the simulated battlefield is under the control of a tank commander who puts the tank through realistic maneuvers. More remote visual control is provided by an auxiliary control device electrically connected to the transmitter and which is co-operable with an optical instrument, being attached for example to the two telescopes of optical binoculars by quick-releasable straps.

Iwamoto et al., U.S. Pat. No. 4,483,407, discloses a vehicle having a pair of endless tracks each extending around a series of wheels arranged in a plane adjacent to one side of the vehicle body. One of the series of wheels on each side of the vehicle body is movable relative to the vehicle body to a selected position to vary the configuration of the endless track in side view so that the vehicle is given a superior running performance and is freely movable along paths having various obstacles.

Merritt, U.S. Pat. No. 5,431,240, discloses a small, maneuverable, self-propelled tracked vehicle equipped with a boom having a tool attached to an extendable section of the boom. The vehicle is small and light enough to enter and be used in places, such as residential yards, in which traditional vehicles with buckets and digging tools, because of their size and weight, cannot be used. A three-stage gear pump powers the tracks and the boom on the bucket or digger. The vehicle has four outriggers to stabilize the vehicle during use, the outriggers arranged substantially perpendicular to each other and at angles of approximately forty-five degrees from the longitudinal axis of the vehicle.

Morris, U.S. D492,621, discloses a design for an armored assault vehicle.

Overlach et al., U.S. Pat. No. 6,899,189, discloses a protective firefighting vehicle comprising a chassis conceived for heavy loads, a driving gear for rough terrain and a tank mounted on the chassis for receiving liquids such as water or fire-extinguishing agents or the like. The tank is divided in at least two chambers via at least one bulkhead-like partition. Provision is made in this connection that at least one of the chambers of the tank can be sealed off in a liquid-tight manner against at least one other chamber of the tank in order to permit the transport of persons in the at least one sealable chamber.

The related art described above discloses compact armored vehicles providing such utilities as armored plating, a plurality of audio and visual devices, a telescopic boom, retractable stabilization legs, remote-control capabilities, and the ability to climb relatively steep inclines. However, the prior art fails to disclose such a vehicle that also provides a plurality of connectors configured for allowing multiple devices to be connected and controlled within the cockpit of the vehicle. In addition, the prior art fails to disclose such a vehicle providing additional connectors at the end of the telescopic boom for connecting devices such as, for example, a video camera, microphone, and speaker in order to simulate face-to-face communications between the driver of the vehicle and a person in proximity to the end of the telescopic boom. In addition, the prior art fails to disclose such a vehicle that that provides at least one horizontally pivotable armored shield positioned and configured for protecting individuals walking alongside the vehicle. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

Police, and similar enforcement officials, have limited options when in a standoff with criminals. Often hostages are involved so that police are reluctant to rush the criminals or use measures that might harm the hostages. The police also do not wish to be harmed. The present invention provides a solution to this by providing a multi-purpose armored vehicle configured to be used for security purposes such as patrols, alarm responses, protection of critical transactions, hostage situations, and bomb threat support. The vehicle is armor-plated and provides a bullet- and explosion-proof glass canopy which covers an entrance to an air-tight operator's compartment capable of accommodating one or two people. In addition, the vehicle is sufficiently compact so as to enable clearance and passage through standard gates, doorways, and living areas. Thus, a police officer can approach a suspect or criminal in the vehicle and initiate a safe face-to-face discussion using a microphone and speaker built into the vehicle. This is psychologically superior to simply speaking to the suspect by phone.

A pair of armor-plated shields are pivotally engaged, and selectively positionable, with the sides of the vehicle, allowing a plurality of individuals to travel alongside the vehicle behind the shields while approaching a potentially dangerous situation, thereby substantially increasing the safety of the individuals on approach.

An extensible boom is engaged with the vehicle. A terminal end of the boom provides a plurality of connectors adapted for removably engaging electric and hydraulic devices. The boom, as well as the devices engaged with the connectors, are configured for being controlled from within the safety of the operator's compartment. A pair of audio-visual devices, including a video monitor, camera, microphone, and speaker, may be engaged with connectors within the operator's compartment and on the boom respectively. This allows for simulated face-to-face communications between the operator within the operator's compartment and a suspect in proximity to the terminal end of the boom, while the vehicle is positioned out of harm's way, which is also psychologically superior to simply speaking to the suspect by phone.

A wide range of electric and hydraulic devices may be removably engaged with the connectors of the vehicle. Hydraulic arms may be engaged with the boom, allowing an operator of the vehicle to approach and disarm bombs or handle radioactive materials. Water jets, pepper spray, loud speakers, munitions, and other lethal and non-lethal weapons may also be engaged with the boom, allowing an operator of the vehicle to subdue a suspect or suppress a large crowd of rioters. These are merely examples of the various devices that may be engaged with the present invention in order to accomplish an array of tasks while simultaneously decreasing the risk of death or bodily harm for all parties involved.

A primary objective inherent in the above described apparatus and method of use is to provide advantages not taught by the prior art.

Another objective is to provide a multi-purpose armored vehicle apparatus that is sufficiently compact so as to enable clearance and passage through standard gates, doorways, and living areas.

A further objective is to provide such an apparatus that is capable of traversing over relatively steep inclines.

A still further objective is to provide such an apparatus that provides an air-tight cockpit to protect the vehicle's occupants from contaminated air outside the vehicle.

A still further objective is to provide such an apparatus that provides a plurality of connectors within the operator's compartment that are configured to enable multiple devices to be connected and controlled from within the cockpit.

A still further objective is to provide such an apparatus that has a telescoping boom which provides additional connectors at the end of the boom for connecting devices.

A still further objective is to provide such an apparatus that provides at least one selectively pivotable armored shield positioned and configured for protecting individuals walking alongside the vehicle.

A still further objective is to provide such an apparatus that is capable of being remotely controlled.

A still further objective is to provide such an apparatus that is constructed in such a way and with such materials as to provide for less than a 3-pound-per-square-inch weight burden on the supporting structure upon which the vehicle may traverse.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Figure 2:
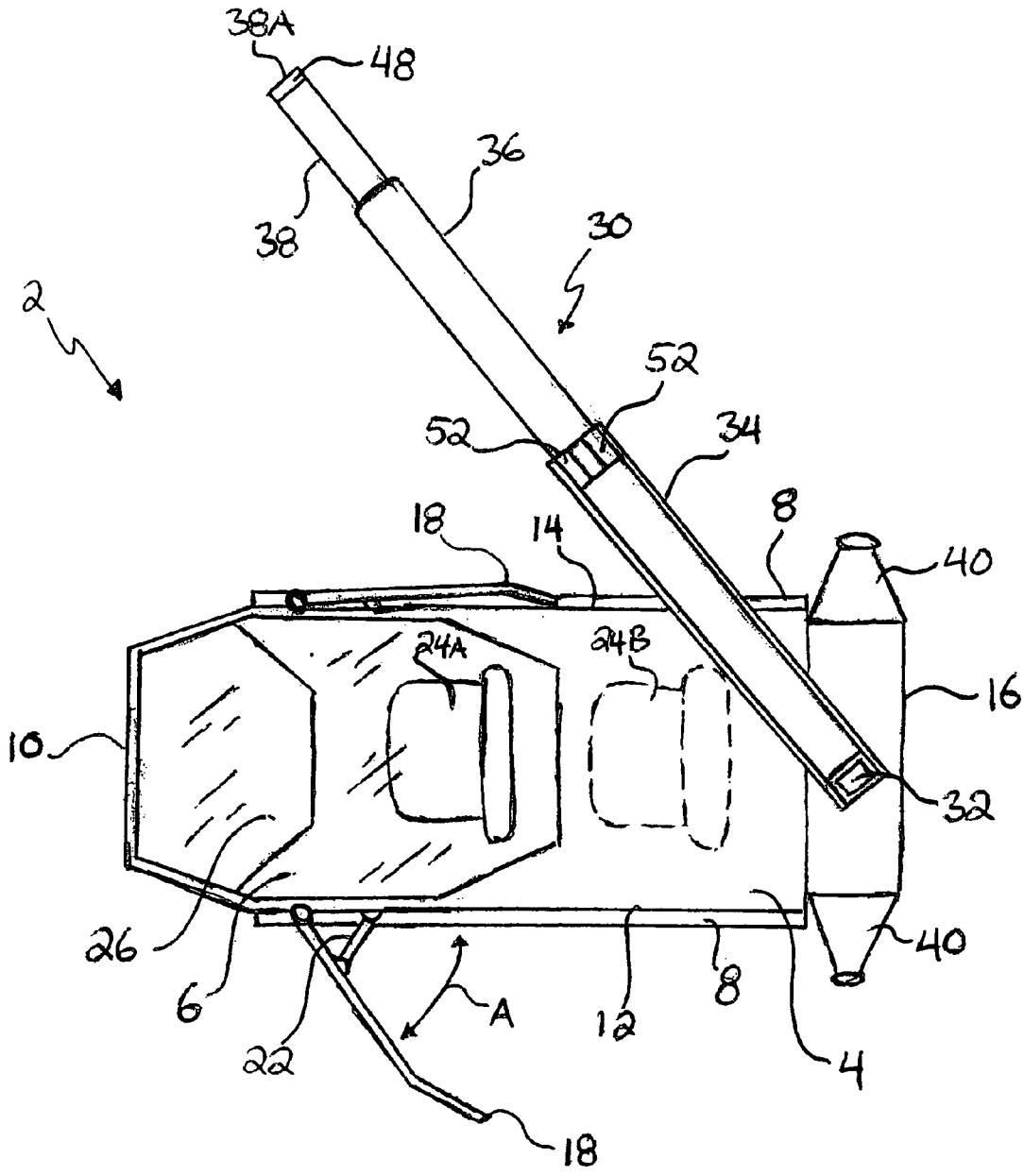
Figure 3:
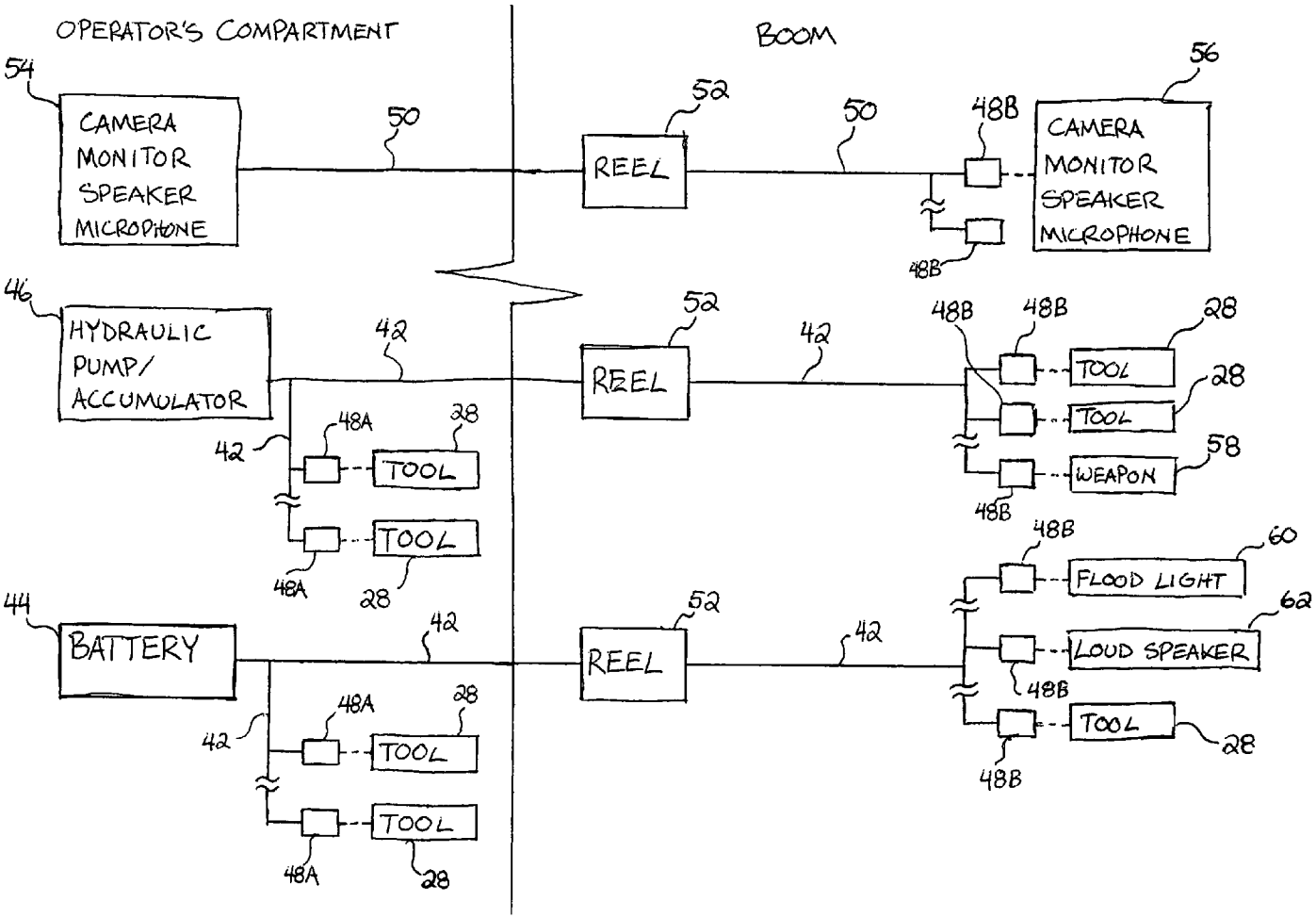

Illustrated in the accompanying drawing(s) is at least one of the best mode embodiments of the present invention In such drawing(s):

FIGS. 1 and 2 are respectively side elevational view and top plan view of the presently described invention; and FIG. 3 is a schematic diagram showing the interrelationship of the major components of the invention.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail is a multi-purpose vehicle apparatus. As shown in FIGS. 1 and 2, the apparatus comprises a vehicle 2 having a body 4 which defines a front aspect 10, opposing medial side aspects 12, a distal rear aspect 16, and a top aspect 14. In addition, the body encloses an operator's compartment 4A, having an entrance proximal to the top aspect 14. The body 4 is armor plated and, preferably, meets Level IV ballistic armor requirements. This is achieved, in one embodiment, by use of heat treated 4130 carbon steel. However, other armor plating materials may be substituted. In addition, as shown best in FIG. 1, the front aspect 10 of the body 4 and the canopy 6 are configured to present rearwardly angled surfaces to moving objects projected toward the vehicle 2.

Preferably the vehicle 2 has a width of approximately 31 inches, enabling the present invention to clear and pass through standard gates, doorways, and living areas. In addition, the vehicle 2 is preferably constructed in such a way and with such materials as to provide for less than a three-pound-per-square-inch weight burden on the supporting structure or terrain upon which the vehicle 2 may traverse. This is accomplished by using high strength, light weight composites known to persons of ordinary skill in the art. Being both compact and relatively lightweight allows the present invention to enter many types of structures with ease and without damaging the structures in any way. The vehicle is capable of climbing standard staircases and of operating in upper floors of conventional building structures.

As shown in FIGS. 1 and 2, a canopy 6 is engaged with the body 4 and positioned for covering the entrance to the operator's compartment 4A. In the preferred embodiment, the canopy 6 is pivotally engaged with the front aspect 10 of the body 4. However, other means of engaging the canopy 6 with the body 4 may be substituted. Preferably, the canopy 6 is made of transparent, bullet-proof and explosion-proof glass; such is well known in the present field of the invention. In addition, the canopy 6 preferably forms an air-tight seal with the body 4, thus creating a safe environment within the operator's compartment 4A and preventing the possibility of contaminated air reaching an operator of the vehicle 2. Preferably, the present invention has an air-scrubbing system as well as a reserve air supply (not shown) to provide the operator's compartment 4A with clean air and positive air pressure in the event of a seal breach between the canopy 6 and the body 4. Such air-scrubbing systems are well known in the art.

As shown in FIGS. 1 and 2, a drive system, including a pair of endless tracks 8, is positioned proximal to the side aspects 12 and engaged with the body 4 for support and movement of the vehicle 2. Each one of the tracks 8 extend around a series of wheels (not shown) arranged in a plane adjacent to the corresponding side aspect 12. This enables the vehicle 2 to rotate within its own length and traverse across inclined surfaces. Each series of wheels is adapted to be driven by a motor (not shown), such as a combustion engine, electric motor, or any other means suitable for driving the wheels known to persons of ordinary skill.

As shown in FIG. 2, a pair of shields 18 are exteriorly engaged with the opposing side aspects 12 of the body 4. Each one of the shields 18 is pivotally engaged with, and selectively positionable with respect to, the body 4. In other words, each one of the shields 18 is capable of pivoting between a first position adjacent to the side aspect 12 of the body 4 and a second position distal from the side aspect 12, thereby forming an included angle A between the shield 18 and the corresponding side aspect 12. The angle A may be selectively set anywhere between 0 degrees and 180 degrees. In one embodiment, positioning of the shields 18 is accomplished by hydraulic cylinders 22 engaged between each one of the shields 18 and the corresponding side 12 of the body 4. In another embodiment, the shields 18 are manually positionable. It should be noted that other means for selectively positioning the shields 18 may be substituted. Preferably each one of the shields 18 is armor plated, similar to the body 4 as discussed above. This allows a plurality of individuals to travel alongside the vehicle 2 behind the shields 18 while approaching a potentially dangerous situation, thereby substantially increasing the safety of the individuals on approach.

As shown in FIGS. 1 and 2, the operator's compartment 4A preferably provides: an operator's seat 24A, a set of vehicle controls 26, and a plurality of first connectors 48A (FIG. 3) for removably engaging a plurality of devices 28. In one embodiment, shown in FIG. 1, the operator's compartment 4A is configured to accommodate a single person. In an alternate embodiment, shown in FIG. 2, the operator's compartment 4A is configured to accommodate two persons, wherein a passenger's seat 24B is positioned within the operator's compartment 4A directly behind the operator's seat 24A; thus, this two-person embodiment is the same width as the single-person embodiment. The vehicle controls 26 enable the operator to accelerate, decelerate, and steer the vehicle 2. It should be noted that, in an alternate embodiment, the present invention is capable of being controlled remotely using means known to persons of ordinary skill in the art. In addition, the vehicle controls 26 enable the operator to control various accessory components, such as the canopy 6, the shields 18, a boom 30 (discussed below), a pair of stabilization legs 40 (discussed below), as well any other devices 28 that may be engaged with the plurality of first connectors 48A. The first connectors 48A are adapted for removably engaging electric and hydraulic devices 28 such as a computer, various tools, and other equipment capable of being driven by electric or hydraulic power.

As shown in FIG. 3, each one of the first connectors 48A is interconnected via energy lines 42 (i.e., electrical wiring and hydraulic lines) with an appropriate one of an electrical energy machine, and a hydraulic energy machine for providing appropriate power to the first connectors. Each of the energy machines are mounted within the body 4 of the vehicle 2. Preferably, the electrical energy machine is a rechargeable battery 44, such as are well known in the art. The hydraulic energy machine is preferably a hydraulic accumulator and a pump system 46 of a conventional type. However, other types of equipment may be substituted.

As shown in FIGS. 1 and 2, an extensible boom 30 is engaged with the vehicle 2 and is positionable between a vertical orientation and a horizontal orientation. The boom 30 comprises a boom mount 32, a first boom segment 34, a second boom segment 36, and a third boom segment 38. Preferably, the boom mount 32 is rotatably engaged with the body 4 of the vehicle 2 proximal to the rear aspect 16 of the body 4, allowing the boom 30 to selectively rotate over a full circle about a vertical axis of the boom mount 32. In alternate embodiments, the boom mount 32 may be engaged with other portions of the body 4. The first boom segment 34 is proximally pivotally engaged with the boom mount 32, as shown in FIG. 2. A hydraulic cylinder 22 is engaged between the boom mount 32 and the first boom segment 34 enabling the first boom segment 34 to be selectively raised and lowered with respect to the boom mount 32. The second boom segment 36 is pivotally engaged with a distal end of the first boom segment 34 and configured to pivot vertically, thereby forming an included angle B between the first and second boom segments 34 and 36. Preferably, the angle B may be selectively set anywhere between 0 degrees and 180 degrees. In alternate embodiments, the angle B may be greater than 180 degrees. The third boom segment 38 is telescopingly engaged with the second boom segment 36. Hydraulic cylinders enable the third boom segment 38 to selectively extend or retract. Thus, the boom 30 is selectively adjustable between a fully retracted state and a fully extended state, the fully extended state providing a reach exceeding the length of the vehicle 2. As shown in FIG. 1, the first boom segment 34 is configured to enable the second and third boom segments 36 and 38 to be positioned within the first boom segment 34 when the boom 30 is not being used.

A terminal end 38A of the third boom segment 38 provides a plurality of second connectors. The second connectors 48B are adapted for removably engaging electric and hydraulic devices 28, and are interconnected via energy lines 42 with the appropriate energy machine 44 and 46, similar to the first connectors 48A discussed above. In addition, an at least one communicator, such as a signal line 50, is interconnected between the second connectors 48B and the vehicle controls 26 within the operator's compartment 4A, thereby enabling the operator to control, from within the operator's compartment 4A, devices 28 engaged with the second connectors 48B. To accommodate for the selective pivotability of the first and second boom segments 34 and 36, couplings (not shown) are engaged with each one of the energy lines 42 and signal lines 50 at the pivot points between the boom segments 34 and 36, thereby enabling the energy lines 42 and signal lines 50 to conform to the selective positioning of the first and second boom segments 34 and 36. In addition, to accommodate for the selective extensibility of the third boom segments 38, a line reel 52 is engaged at the pivot point between the first and second boom segments 34 and 36. The line reel 52 is configured for storing a length of each one of the energy lines 42 and signal lines 50 into a mechanical reel capable of automatically unrolling and rolling the necessary length of each one of the lines 42 and 50 as the third boom segment 38 extends and retracts respectively. As discussed above, the boom 30 is controllable via the vehicle controls 26 within the operator's compartment 4A.

As shown in FIGS. 1 and 2, a pair of retractable stabilization legs 40 are engaged with the vehicle 2. Preferably, the stabilization legs 40 are mounted proximal to the rear aspect 16 of the body 4 in opposing lateral positions. In an extended position, the stabilization legs 40 provide stability and rigidity to the vehicle 2 when the vehicle 2 is stationary, allowing the boom 30 to be maneuvered without the possibility of tipping the vehicle 2. When the boom 30 is not in use, the stabilization legs 40 may be moved to a retracted position, thereby allowing the vehicle 2 to travel. Preferably, hydraulic cylinders enable the stabilization legs 40 to alternate between the extended and retracted positions. As discussed above, the stabilization legs 40 are controllable via the vehicle controls 26 within the operator's compartment 4A. It should be noted that other means for extending and retracting the stabilization legs 40, including manually, may be substituted.

In one embodiment, as shown in FIG. 3, a first audio-visual device 54 is mounted within the operator's compartment 4A. In addition, a second audio-visual device 56 is engaged with the second connectors 48B on the boom 30. Each of the audio-visual devices 54 and 56 preferably provides a video monitor, a video camera, a microphone, and a speaker. The first and second audio-visual devices 54 and 56 are interconnected, either by the signal lines 50 or wireless signals, in order to simulate face-to-face communications between the operator within the operator's compartment 4A and a person proximal to the terminal end 38A of the boom 30.

In another embodiment, lethal and/or non-lethal weapons 58 are engaged with the second connectors 48B. In another embodiment, various hydraulic tools 28 are engaged with the second connectors 48B, such as a cutter, a spreader, or a battering ram. In yet another embodiment, various electric devices are engaged with the second connectors 48B, such as a flood light 60, or a loud speaker 62. In yet another embodiment, a water tank and/or foam generator (not shown) is engaged with the second connectors 48B in order to facilitate fire suppression and to be rapidly pumped into the area of a barricaded suspect to provide cover and remove the sense of orientation for the suspect. Similar to the other devices 28 discussed above, these devices 28 are controllable via the vehicle controls 26 within the operator's compartment 4A. These alternate embodiments are merely examples of the wide range of devices 28 that may be engaged with the present invention in order to accomplish an array of tasks while simultaneously decreasing the risk of death or bodily harm for all parties involved.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A multi-purpose vehicle apparatus comprising:

a vehicle configured with a length, a width and a height, the vehicle having:

a body defining a proximal front aspect, opposing medial side aspects, a distal rear aspect and a top aspect; the body enclosing an operator's compartment having an entrance thereto proximal the top aspect; the operator's compartment having therewithin a plurality of first connectors;

a canopy engaged with the body and covering the entrance to the operator's compartment;

a drive system including a pair of opposing tracks positioned proximal the side aspects and engaged with the body for support and movement thereof; and an extensible boom engaged with the vehicle proximate the rear aspect thereof, the boom positionable between a vertical orientation and a horizontal orientation and rotatable over a full circle about a vertical axis thereof; the boom comprising a plurality of boom segments for selectively adjusting the boom between a fully retracted state and a fully extended state, the fully extended state providing a reach exceeding the length of the vehicle;

a plurality of second connectors mounted distally on the boom, the second connectors interconnected with at least one of the first connectors through at least one length adjustable communicator mounted on, and extensible with the boom;

whereby devices engaged with the first and second connectors are controllable from within the operator's compartment.

2. The multi-purpose vehicle apparatus of claim 1 wherein devices engaged with the first and second connectors include a first audio-visual device engaged with the first connectors and a second audio-visual device engaged with the second connectors.

3. The multi-purpose vehicle apparatus of claim 2 wherein each of the first and second audio-visual devices provide: a video monitor, a video camera, a microphone, and a speaker, whereby virtual face-to-face communication is possible between a person proximal the second audio-visual device and a person in the operator's compartment proximal the first audio-visual device.

4. The multi-purpose vehicle apparatus of claim 1 further comprising a pair of retractable stabilization legs engaged with the vehicle body in opposing lateral positions.

5. The multi-purpose vehicle apparatus of claim 1 wherein the boom comprises at least three segments thereof, mutually engaged pairs of the segments joined in one of linear and folding interaction.

6. The multi-purpose vehicle apparatus of claim 5 wherein the second segment of the boom is positionable within the first segment of the boom and is rotatable about a horizontal axis into a collinear relationship therewith.

7. The multi-purpose vehicle apparatus of claim 5 wherein a third segment of the boom is positionable within the second segment of the boom and is linearly extendable therefrom.

8. The multi-purpose vehicle apparatus of claim 1 wherein a plurality of energy lines are engaged between the second connectors and an appropriate one of an electrical energy machine, and a hydraulic energy machine, each of energy machines mounted within the body of the vehicle, the energy lines providing appropriate power to the second connectors.

9. The multi-purpose vehicle apparatus of claim 8 wherein an at least one signal line is engaged between the at least one communicator and a control panel located within the operator's compartment, the at least one signal line enabling communication between the control panel and the second connectors.

10. The multi-purpose vehicle apparatus of claim 9 wherein a plurality of couplings are engaged with each one of the energy lines and signal lines at pivot points between each of a first and second boom segments, enabling the energy lines and signal lines to conform to the selective positioning of the first and second boom segments.

11. The multi-purpose vehicle apparatus of claim 1 further comprising a selectively positionable armor shield mounted exteriorly to the body and proximal at least one of the front and the side aspects thereof.

12. The multi-purpose vehicle apparatus of claim 1 further comprising an armor shield engaged with the vehicle, wherein the armor shield is pivotal between a first position adjacent the side aspect of the vehicle, and a second position distal from said side aspect.

13. The multi-purpose vehicle apparatus of claim 1 wherein the canopy is made of transparent, bullet-proof and explosion-proof glass.

14. The multi-purpose vehicle apparatus of claim 1 wherein the front aspect of the vehicle and the canopy are configured to present rearwardly angled surfaces to moving objects projected toward the vehicle.

15. The multi-purpose vehicle apparatus of claim 1 wherein the vehicle width is not greater than 31 inches.

16. The multi-purpose vehicle apparatus of claim 1 wherein the boom is operated by a hydraulic pump with a hydraulic accumulator.

17. The multi-purpose vehicle apparatus of claim 1 wherein the second connectors are configured to accept flood lights, loud speakers, weapons, weapon launchers, crowd disbursing materials dispensers, battering rams and structure opening tools.

* * * * *